US012686926B2

(12) United States Patent
Grigorieva et al.

(10) Patent No.: US 12,686,926 B2
(45) Date of Patent: Jul. 21, 2026

(54) PRESS HARDENING METHOD

(71) Applicant: ArcelorMittal, Luxembourg (LU)

(72) Inventors: Raisa Grigorieva, Metz (FR); Florin Duminica, Tilff (BE); Brahim Nabi, Leuven (BE); Pascal Drillet, Rozérieulles (FR); Thierry Sturel, Le Ban Saint Martin (FR)

(73) Assignee: ArcelorMittal, Luxembourg (LU)

( * ) Notice: Subject to any disclaimer, the term of this patent is extended or adjusted under 35 U.S.C. 154(b) by 15 days.

(21) Appl. No.: 17/771,892

(22) PCT Filed: Oct. 20, 2020

(86) PCT No.: PCT/IB2020/059841
§ 371 (c)(1),
(2) Date: Apr. 26, 2022

(87) PCT Pub. No.: WO2021/084378
PCT Pub. Date: May 6, 2021

(65) Prior Publication Data

US 2022/0380905 A1 Dec. 1, 2022

(30) Foreign Application Priority Data

Oct. 30, 2019 (WO) ..... PCT/IB2019/059287

(51) Int. Cl.

| | |
|---|---|
| ***C23C 28/02*** | (2006.01) |
| ***C21D 8/0247*** | (2026.01) |
| ***C21D 8/0278*** | (2026.01) |
| ***C21D 9/46*** | (2006.01) |

(52) U.S. Cl.
CPC ..... *C23C 28/021* (2013.01); *C21D 8/0252* (2013.01); *C21D 8/0284* (2013.01); *C21D 9/46* (2013.01); *C21D 2211/001* (2013.01); *C21D 2211/002* (2013.01); *C21D 2211/005* (2013.01); *C21D 2241/01* (2013.01); *C21D 2261/00* (2013.01)

(58) Field of Classification Search
CPC ..... C23C 28/021; C21D 8/0284; C21D 9/46; C21D 2211/002; C21D 2211/005; C21D 2241/01; C21D 2261/00; C21D 1/18
See application file for complete search history.

(56) References Cited

U.S. PATENT DOCUMENTS

| | | | |
|---|---|---|---|
| 6,336,349 | B1 | 1/2002 | Hauger et al. |
| 2008/0083477 | A1 | 4/2008 | Drillet et al. |
| 2010/0065160 | A1 | 3/2010 | Meurer |
| 2012/0090737 | A1 | 4/2012 | Fushikawa et al. |
| 2013/0153094 | A1 | 6/2013 | Verloop et al. |
| 2014/0119976 | A1* | 5/2014 | Chen ..... C22C 38/20 420/60 |
| 2014/0134450 | A1 | 5/2014 | Eberlein |
| 2014/0234658 | A1 | 8/2014 | Nozaki et al. |
| 2015/0013409 | A1 | 1/2015 | Monnoyer et al. |
| 2016/0017452 | A1* | 1/2016 | Puerta Velasquez ..... C21D 8/0205 148/333 |
| 2016/0122889 | A1 | 5/2016 | Muhr et al. |
| 2016/0222484 | A1 | 8/2016 | Koyer et al. |
| 2016/0237585 | A1 | 8/2016 | Eberlein et al. |
| 2017/0029918 | A1 | 2/2017 | Panier et al. |
| 2017/0073789 | A1 | 3/2017 | Schuhmacher et al. |
| 2017/0253941 | A1 | 9/2017 | Cobo et al. |
| 2017/0321314 | A1 | 11/2017 | Kolnberger |
| 2018/0044774 | A1* | 2/2018 | Allely ..... B32B 15/012 |
| 2018/0223386 | A1* | 8/2018 | Machado Amorim ... C23C 2/28 |
| 2019/0345579 | A1 | 11/2019 | Blaise et al. |
| 2021/0254189 | A1 | 8/2021 | An et al. |
| 2022/0380861 | A1 | 12/2022 | Grigorieva et al. |

FOREIGN PATENT DOCUMENTS

| | | | |
|---|---|---|---|
| CN | 101072892 | A | 11/2007 |
| CN | 101506403 | A | 8/2009 |
| CN | 103827335 | | 5/2014 |
| CN | 106574348 | A | 4/2017 |
| CN | 109821951 | A | 5/2019 |
| CN | 110073010 | | 7/2019 |
| DE | 102013010025 | A1 | 12/2014 |
| EP | 1074317 | | 2/2001 |

(Continued)

OTHER PUBLICATIONS

Search Report of PCT/IB2020/0059838 dated Aug. 12, 2020.

(Continued)

*Primary Examiner* — Jonathan Johnson

(74) *Attorney, Agent, or Firm* — Davidson Kappel LLC

(57) ABSTRACT

A press hardening method including: A. providing a steel sheet for heat treatment, being optionally precoated with an aluminum-based pre-coating, B. deposition of a hydrogen barrier pre-coating comprising chromium and not comprising nickel over a thickness from 10 to 550 nm, C. cutting the precoated steel sheet to obtain a blank, D. heat treating the blank at a furnace temperature from 800 to 970° C., during a dwell time from 1 to 12 minutes, in an atmosphere having an oxidizing power equal or higher than that of an atmosphere consisting of 1% by volume of oxygen and equal or smaller than that of an atmosphere consisting of 50% by volume of oxygen, and having a dew point between −30 and +30° C., E. transferring the blank into a press tool, F. hot-forming at a temperature from 600 to 830° C. to obtain a part, G. cooling the part.

10 Claims, No Drawings

(56) References Cited

FOREIGN PATENT DOCUMENTS

| | | | | |
|---|---|---|---|---|
| EP | 2312005 | | | 4/2011 |
| EP | 2377965 | A2 | | 10/2011 |
| EP | 2778247 | | | 9/2014 |
| EP | 2944706 | A1 | | 11/2015 |
| EP | 2984198 | A1 | | 2/2016 |
| EP | 3056591 | A1 | | 8/2016 |
| EP | 3094756 | A1 | | 11/2016 |
| EP | 3329029 | A1 | | 6/2018 |
| EP | 3396010 | A1 | | 10/2018 |
| EP | 3438316 | A1 | | 2/2019 |
| EP | 3175006 | B1 | | 3/2019 |
| EP | 3 521481 | A1 | | 8/2019 |
| EP | 2893047 | B1 | | 4/2020 |
| JP | H08176804 | A | * | 7/1996 |
| JP | 2005097725 | A | | 4/2005 |
| KR | 20130099042 | A | | 9/2013 |
| WO | WO2014166630 | A1 | | 10/2014 |
| WO | WO2015107393 | A1 | | 7/2015 |
| WO | WO2017017521 | A1 | | 2/2017 |
| WO | WO2017/187255 | | | 11/2017 |
| WO | WO 2018/158166 | A1 | | 9/2018 |
| WO | WO2020/070545 | | | 4/2020 |
| WO | WO 2021/084377 | A1 | | 4/2021 |
| WO | WO 2021/081377 | A1 | | 5/2021 |
| WO | WO2021/084376 | A1 | | 5/2021 |
| WO | WO 2021/084378 | A1 | | 5/2021 |
| WO | WO 2021/084379 | A1 | | 5/2021 |

OTHER PUBLICATIONS

Written Opinion of PCT/IB2020/059838.
Search Report of PCT/IB2020/0059837 dated Sep. 12, 2020.
Written Opinion of PCT/IB2020/059837.
Windmann M et al, "Formation of intermetallic phases in AI-coated hot-stamped 22MnB5 sheets in terms of coating thickness and Si content", Surface and Coatings Technology, (Jul. 1, 2014), vol. 246; pp. 17-25.
Search Report of PCT/IB2020/0059842 dated Nov. 26, 2020.
Written Opinion of PCT/IB2020/059842.
Search Report of PCT/IB2020/0059841 dated Jan. 1, 2020.
Written Opinion of PCT/IB2020/059841.

* cited by examiner

PRESS HARDENING METHOD

The present invention relates to a press hardening method comprising the provision of a steel sheet for heat treatment coated with a barrier coating. This hydrogen barrier pre-coating inhibits better hydrogen absorption and enhances resistance to delayed fracture. The invention is particularly well suited for the manufacture of automotive vehicles.

Coated steel sheets for press hardening are sometimes termed "pre-coated," this prefix indicating that a transformation of the nature of the pre-coating will take place during heat treatment before stamping. There can be more than one pre-coating. This invention discloses one pre-coating, optionally two pre-coatings.

BACKGROUND

It is known that certain applications, especially in the automotive field, require metal structures to be further lightened and strengthened in the event of an impact, and also require good drawability. To this end, steels having improved mechanical properties are usually used, such steel being formed by cold and hot-stamping.

SUMMARY OF THE INVENTION

However, it is known that the sensitivity to delayed fracture increases with the mechanical strength, after certain cold-forming or hot-forming operations since high residual stresses are liable to remain after deformation. In combination with atomic hydrogen possibly present in the Steel sheet, these stresses are liable to result in delayed fracture, cracking that occurs a certain time after the deformation itself. Hydrogen may progressively build up by diffusion into the crystal lattice defects, such as the matrix/inclusion interfaces, twin boundaries and grain boundaries. It is in the latter defects that hydrogen may become harmful when it reaches a critical concentration after a certain time. This delay results from the residual stress distribution field and from the kinetics of hydrogen diffusion, the hydrogen diffusion coefficient at room temperature being low. In addition, hydrogen localized at the grain boundaries weakens their cohesion and favors the appearance of delayed intergranular cracks.

Press hardening is known as critical for hydrogen absorption, increasing the sensitivity to delayed fracture. Absorption may occur at the austenitization heat treatment, which is the heating step prior to the hot press forming itself. The absorption of hydrogen into Steel is indeed dependent from the metallurgic phase. Furthermore, at high temperature the water in the furnace dissociates at the surface of the steel sheet into hydrogen and oxygen.

WO2017/187255 discloses a pre-coating having the effect of a barrier to prevent hydrogen absorption, especially during the heat treatment prior to hot forming. This hydrogen barrier pre-coating comprises nickel and chromium wherein the weight ratio Ni/Cr is between 1.5 and 9. This patent application discloses an atmosphere of heat treatment being an inert atmosphere or an atmosphere comprising air. All the Examples are performed in an atmosphere consisting of nitrogen.

According to WO2020/070545, the heat treatment prior to hot forming may occur in an atmosphere having an oxidizing power equal or higher than that of an atmosphere consisting of 1% by volume of oxygen and equal or smaller than that of an atmosphere consisting of 50% by volume of oxygen, such atmosphere having a dew point between −30 and +30° C., so as to further reduce hydrogen absorption.

In both patent applications, although the hydrogen absorption during the austenitization heat treatment is improved, it is not enough to obtain a part having an excellent resistance to delayed fracture. Indeed, even if the pre-coated barrier decreases the hydrogen absorption, few hydrogen molecules are still absorbed by the steel sheet.

It is an object of the present invention to provide a press hardening method wherein the hydrogen adsorption into the steel sheet is prevented. The present invention also additionally or alternatively aims to make available a part having excellent resistance to delayed fracture obtainable by said press-hardening method including hot-forming.

The present invention provides a press hardening method comprising the following steps:

A. the provision of a steel sheet for heat treatment, being optionally precoated with a zinc- or aluminum-based pre-coating,
B. the deposition of a hydrogen barrier pre-coating comprising chromium and not comprising nickel over a thickness from 10 to 550 nm,
C. the cutting of the precoated steel sheet to obtain a blank,
D. the heat treatment of the blank at a furnace temperature from 800 to 970° C., during a dwell time from 1 to 12 minutes, in an atmosphere having an oxidizing power equal or higher than that of an atmosphere consisting of 1% by volume of oxygen and equal or smaller than that of an atmosphere consisting of 50% by volume of oxygen, such atmosphere having a dew point between −30 and +30° C.,
E. the transfer of the blank into a press tool,
F. the hot-forming of the blank at a temperature from 600 to 830° C. to obtain a part,
G. the cooling of the part obtained at step E) to obtain a microstructure in steel being martensitic or martensito-bainitic or made of at least 75% in terms of volume fraction of equiaxed ferrite, from 5 to 20% in volume of martensite and bainite in amount less than or equal to 10% in volume.

DETAILED DESCRIPTION

Indeed, the inventors have surprisingly found that when the steel sheet is pre-coated with a hydrogen barrier pre-coating comprising chromium and not comprising nickel and when the austenitization heat treatment is performed in the above atmosphere, this barrier effect of the pre-coating is further improved preventing even more the absorption of hydrogen into the steel sheet. On the contrary to an atmosphere consisting of nitrogen with which a thinner layer of selective oxides is formed on the surface of the hydrogen barrier pre-coating during the austenitization heat treatment, it is believed that thermodynamically stable oxides are formed on the surface of the barrier pre-coating with a low kinetic of hydrogen diffusion.

In the specific above atmosphere, it is believed that the hydrogen barrier pre-coating comprising chromium and not comprising nickel allows a higher reduction of hydrogen absorption than the hydrogen barrier pre-coating comprising nickel and chromium. Indeed, it is believed that the chromium forms an oxide layer thicker than the one formed by nickel and chromium. Without willing to be bound by any theory, it is believed that the hydrogen barrier pre-coating comprising chromium and not comprising nickel can prevent water dissociation at the hydrogen barrier pre-coating surface and also prevent the hydrogen diffusion through the hydrogen barrier pre-coating. With an atmosphere having an oxidizing power equal or higher than that of an atmosphere consisting of 1% volume percent oxygen and equal or smaller than that of an atmosphere consisting of 50% by volume of oxygen, it is believed that the oxides being thermodynamically stable further inhibit the water dissociation.

One of the essential characteristics of the method according to the invention consists in choosing the atmosphere having an oxidizing power equal or higher than that of an atmosphere consisting of 1% by volume of oxygen and equal or smaller than that of an atmosphere consisting of 50% by volume of oxygen.

In step A), the steel sheet used is made of steel for heat treatment as described in the European Standard EN 10083. It can have a tensile resistance superior to 500 MPa, advantageously between 500 and 2000 MPa before or after heat-treatment.

The weight composition of steel sheet is preferably as follows: 0.03%≤C≤0.50% 0.3%≤Mn≤3.0% 0.05%≤Si≤0.8% 0.015%≤Ti≤0.2% 0.005%≤Al≤0.1% 0%≤Cr≤2.50% 0%≤S≤0.05% 0%≤P≤0.1%; 0%≤B≤0.010%; 0%≤Ni≤2.5% 0%≤Mo≤0.7% 0%≤Nb≤0.15% 0%≤N≤0.015% 0%≤Cu≤0.15% 0%≤Ca≤0.01% 0%≤W≤0.35%, the balance being iron and unavoidable impurities from the manufacture of steel.

For example, the steel sheet is 22MnB5 with the following composition: 0.20%≤C≤0.25%; 0.15%≤Si≤0.35%; 1.10%≤Mn≤1.40%; 0%≤Cr≤0.30%; 0%≤Mo≤0.35%; 0%≤P≤0.025%; 0%≤S≤0.005%; 0.020%≤Ti≤0.060%; 0.020%≤Al≤0.060%; 0.002%≤B≤0.004%, the balance being iron and unavoidable impurities from the manufacture of steel.

The steel sheet can be Usibor®2000 with the following composition: 0.24%≤C≤0.38%; 0.40%≤Mn≤3%; 0.10%≤Si≤0.70%; 0.015%≤Al≤0.070%; 0%≤Cr≤2%; 0.25%≤Ni≤2%; 0.020%≤Ti≤0.10%; 0%≤Nb≤0.060%; 0.0005%≤B≤0.0040%; 0.003%≤N≤0.010%; 0.0001%≤S≤0.005%; 0.0001%≤P≤0.025%; it being understood that the contents of titanium and nitrogen satisfy Ti/N>3.42; and that the contents of carbon, manganese, chromium and silicon satisfy:

$$2.6C + \frac{Mn}{5.3} + \frac{Cr}{13} + \frac{Si}{15} \geq 1.1\%$$

the composition optionally comprising one or more of the following: 0.05%≤Mo≤0.65%; 0.001%≤W≤0.30%; 0.0005%≤Ca≤0.005%, the balance being iron and unavoidable impurities from the manufacture of steel.

For example, the Steel sheet is Ductibor®500 with the following composition: 0.040%≤C≤0.100%; 0.80%≤Mn≤2.00%; 0%≤Si≤0.30%; 0%≤S≤0.005%; 0%≤P≤0.030%; 0.010%≤Al≤0.070%; 0.015%≤Nb≤0.100%; 0.030%≤Ti≤0.080%; 0%≤N≤0.009%; 0%≤Cu≤0.100%; 0%≤Ni≤0.100%; 0%≤Cr≤0.100%; 0%≤Mo≤0.100%; 0%≤Ca≤0.006%, the balance being iron and unavoidable impurities from the manufacture of steel.

Steel sheet can be obtained by hot rolling and optionally cold rolling depending on the desired thickness, which can be for example between 0.7 and 3.0 mm.

In step A), the steel sheet can be directly topped by a zinc or aluminum-based pre-coating for anticorrosion purposes. In a preferred embodiment, the zinc- or aluminum-based pre-coating is based on aluminum and comprises less than 15% Si, less than 5.0% Fe, optionally 0.1 to 8.0% Mg and optionally 0.1 to 30.0% Zn, the remainder being Al. For example, the zinc- or aluminum-based pre-coating is AluSi®.

In another preferred embodiment, the zinc- or aluminum-based pre-coating is based on zinc and comprises less than 6.0% Al, less than 6.0% of Mg, the remainder being Zn. For example, the zinc- or aluminum-based pre-coating is a zinc coating so to obtain the following product: Usibor® GI.

The zinc or aluminum-based pre-coating can also comprise impurities and residual elements such as iron with a content up to 5.0%, preferably 3.0%, by weight.

Optionally, in step B), the hydrogen barrier pre-coating comprises elements chosen from Sr, Sb, Pb, Ti, Ca, Mn, Sn, La, Ce, Cr, Zr or Bi, the content by weight of each additional element being inferior to 0.3% by weight.

In a preferred embodiment, in step B, the hydrogen barrier pre-coating does not comprise at least one of the elements chosen from Al, Fe, Si, Zn, and N. Indeed, without willing to be bound by any theory, there is a risk that the presence of at least one of these elements decreases the barrier effect of the hydrogen pre-coating.

Preferably, in step B, the hydrogen barrier pre-coating consists of Cr at 50% or 75% or 90% by weight. More preferably it consists of Cr, i.e. the hydrogen barrier pre-coating comprises only Cr and additional elements.

Preferably, in step B, no further pre-coating is deposited on the hydrogen barrier pre-coating before steps C to F).

Preferably, in step B, the hydrogen barrier pre-coating has a thickness between 10 and 90 or between 150 and 250 nm. For example, the thickness of the barrier pre-coating is of 50, 200 or 400 nm.

Without willing to be bound by any theory, it seems that when the barrier pre-coating is below 10 nm, there is a risk that hydrogen absorbs into steel because the barrier pre-coating does not cover enough the steel sheet. When the barrier pre-coating is above 550 nm, it seems that there is a risk that the barrier pre-coating becomes more brittle and that the hydrogen absorption begins due to the barrier pre-coating brittleness.

The pre-coatings can be deposited by any methods known to the man skilled in the art, for example hot-dip galvanization process, roll coating, electrogalvanization process, physical vapor deposition such as jet vapor deposition, magnetron sputtering, or electron beam induced deposition. Preferably, the hydrogen barrier pre-coating is deposited by electron beam induced deposition or roll coating. After the deposition of the pre-coatings, a skin-pass can be realized and allows work hardening the precoated steel sheet and giving it a roughness facilitating the subsequent shaping. A degreasing and a surface treatment can be applied in order to improve for example adhesive bonding or corrosion resistance.

After the provision of the steel sheet precoated with the metallic pre-coating according to the present invention, the precoated steel sheet is cut to obtain a blank. A heat treatment is applied to the blank in a furnace. Preferably, the heat treatment is performed under non-protective atmosphere or under protective atmosphere at a temperature between 800 and 970° C. More preferably, the heat treatment is performed at an austenitization temperature Tm usually between 840 and 950° C., preferably 880 to 930° C. Advantageously, said blank is maintained during a dwell time tm between 1 to 12 minutes, preferably between 3 to 9 minutes. During the heat treatment before the hot-forming, the pre-coating forms an alloy layer having a high resistance to corrosion, abrasion, wear and fatigue.

Preferably, in step C), the atmosphere has an oxidizing power equal or higher than that of an atmosphere consisting of 10% by volume of oxygen and equal or smaller than that of an atmosphere consisting of 30% by volume of oxygen. For example, the atmosphere is air, i.e. consisting of about 78% of $N_2$, about 21% of 02 and other gas such as rare gases, carbon dioxide and methane.

Preferably, in step C), the dew point is between −20 and +20° C. and advantageously between −15° C. and +15° C. Indeed, without willing to be bound by any theory, it is believed that when the dew point is in the above range, the layer of thermodynamically stable oxides reduce even more the $H_2$ adsorption during the heat treatment.

The atmosphere may be made of $N_2$ or Ar or mixtures of nitrogen or argon and gas oxidants such as, for example, oxygen, mixtures of CO and $CO_2$ or mixtures of $H_2$ and $H_2O$. it is also possible to use mixtures of CO and $CO_2$ or mixtures of $H_2$ and $H_2$ without addition of inert gas.

After the heat treatment, the blank is then transferred to a hot-forming tool and hot-formed at a temperature between 600 and 830° C. The hot-forming can be the hot-stamping or the roll-forming. Preferably, the blank is hot-stamped. The part is then cooled in the hot-forming tool or after the transfer to a specific cooling tool.

The cooling rate is controlled depending on the steel composition, in such a way that the final microstructure after the hot-forming comprises mostly martensite, preferably contains martensite, or martensite and bainite, or is made of at least 75% of equiaxed ferrite, from 5 to 20% of martensite and bainite in amount less than or equal to 10%.

A hardened part having excellent resistance to delayed fracture according to the invention is thus obtained by hot forming. Optionally, the part comprises a steel sheet pre-coated with a zinc- or aluminum-based pre-coating for anticorrosion purposes. Preferably, the part comprises a steel sheet precoated with a hydrogen barrier pre-coating comprising chromium and not comprising nickel and an oxide layer comprising thermodynamically stable iron, chromium oxides and not comprising nickel oxides, such hydrogen barrier pre-coating being alloyed through diffusion with the steel sheet.

More preferably, the steel sheet directly topped by a zinc- or aluminum-based pre-coating, this zinc- or aluminum-based coating layer being directly topped by the hydrogen barrier pre-coating comprising chromium and not comprising nickel. The hydrogen barrier pre-coating includes an oxide layer comprising thermodynamically stable iron, chromium oxides and not comprising nickel oxides. The hydrogen barrier pre-coating is alloyed by diffusion with the zinc- or aluminum-based pre-coating, the zinc- or aluminum-based pre-coating is also alloyed with the steel sheet. Without willing to be bound by any theory, it seems that iron from steel diffuses to the surface of the hydrogen barrier pre-coating during the heat treatment. With the atmosphere of step C), it is believed that iron and chromium slowly oxidize forming thermodynamically stable oxides preventing hydrogen absorption into the steel sheet.

Preferably, the thermodynamically stable chromium and iron oxides can comprise $Cr_2O_3$, FeO, $Fe_2O_3$ and/or $Fe_3O_4$ or a mixture thereof If a pre-coating based on zinc is present, the oxides can also comprise ZnO. If a pre-coating based on aluminum is present, the oxides can also comprise $Al_2O_3$.

For automotive application, after a phosphating step, the part is dipped in an e-coating bath. Usually, the thickness of the phosphate layer is between 1 and 2 μm and the thickness of the e-coating layer is between 15 and 25 μm, preferably inferior or equal to 20 μm. The cataphoresis layer ensures an additional protection against corrosion. After the e-coating step, other paint layers can be deposited, for example, a primer coat of paint, a basecoat layer and a top coat layer.

Before applying the e-coating on the part, the part is previously degreased and phosphated so as to ensure the adhesion of the cataphoresis layer.

The invention will now be explained in trials carried out for information only. They are not limiting.

EXAMPLES

For all samples, steel sheets used are 22MnB5. The composition of the steel is as follows: C=0.2252% Mn=1.1735% P=0.0126%, S=0.0009% N=0.0037% Si=0.2534% Cu=0.0187% Ni=0.0197% Cr=0.180% Sn=0.004% Al=0.0371% Nb=0.008% Ti=0.0382% B=0.0028% Mo=0.0017% As=0.0023% et V=0.0284%.

Some steel sheets are precoated with a $1^{st}$ pre-coating being an anticorrosion pre-coating called hereinafter "AluSi®". This pre-coating comprises 9% by weight of Silicon, 3% by weight of iron, the balance being aluminum. It is deposited by hot-dip galvanization.

Some steel sheets are coated with a $2^{nd}$ pre-coating deposited by magnetron sputtering.

Example 1: Hydrogen Test

This test is used to determine the quantity of hydrogen adsorbed during the austenitization heat treatment of a press hardening method.

Trials are steel sheets precoated with a 1st pre-coating being AluSi® (25 μm) and a $2^{nd}$ pre-coating comprising 80% of Ni and 20% of Cr or consisting of Cr.

After the deposition of the pre-coatings, coated trials were cut in order to obtain a blank. Blanks were then heated at a temperature of 900° C. during a dwell time varying between 5 and 10 minutes. The atmosphere during the heat treatment was air or nitrogen with a dew point between −15° C. and +15° C. Blanks were transferred into a press tool and hot-stamped in order to obtain parts having an omega shape. Then, parts were cooled by dipping trials into warm water to obtain a hardening by martensitic transformation.

Finally, the hydrogen amount adsorbed by the trials during the heat treatment was measured by thermic desorption using a Thermal Desorption Analyser or TDA. To this end, each trial was placed in a quartz room and heated slowly in an infra-red furnace under a nitrogen flow. The released mixture hydrogen/nitrogen was picked up by a leak detector and the hydrogen concentration was measured by a mass spectrometer.

Results are shown in the following Table 1:

| Trials | Atmosphere | Dew Point (° C.) | $2^{nd}$ pre-coating | Ratio Ni/Cr | Thickness $2^{nd}$ pre-coating (nm) | $H_2$ amount (ppm by mass) |
|---|---|---|---|---|---|---|
| 1 (PCT/IB2018/057719) | air | +15° C. | Ni/Cr 80/20 | 4 | 200 | 0.2 |
| 2 (PCT/IB2018/057719) | $N_2$ | +15° C. | Ni/Cr 80/20 | 4 | 200 | 0.4 |
| 3 (WO2017187255) | $N_2$ | +15° C. | Cr | — | 200 | 0.4 |
| 4* | air | +15° C. | Cr | — | 200 | 0.09 |

*examples according to the invention.

Trial 4 according to the present invention release a very low amount of hydrogen compared to comparative examples.

After heat treatment and hot forming, the surface of trial 4 has been analyzed. It comprises following oxides on the surface: $Cr_2O_3$, $Fe_2O_3$, $Fe_3O_4$ and $Al_2O_3$.

From the steel sheet to the external surface, the part of trial 4 comprises the following layers:

- an inter-diffusion layer comprising iron from the steel sheet, aluminum, silicon and other elements, having a thickness from 10 to 15 μm,
- an alloyed layer containing aluminum, silicon and iron from the steel sheet in a lesser amount than the layer below and other elements, having a thickness from 20 to 35 μm,
- a thin layer containing less iron and more oxides than the layers below, having a thickness from 100 to 300 nm,
- a thinner layer containing the highest amount of oxides compared to the layers below, especially Cr and Al oxides, and located directly below the surface, having a thickness from 50 to 150 nm.

What is claimed is:

1. A press hardening method comprising the following steps:

A. providing a steel sheet for heat treatment, the steel sheet being uncoated or having an aluminum-based pre-coating as a top surface of the steel sheet;

B. depositing, (i) directly onto the uncoated steel sheet of step A or (ii) directly onto the aluminum-based pre-coating of step A, a hydrogen barrier pre-coating comprising at least 50% chromium and not comprising nickel with a thickness from 10 to 550 nm;

C. cutting of the precoated steel sheet to obtain a blank;

D. heat treating the blank at a furnace temperature from 800 to 970° C., for a dwell time from 1 to 12 minutes, in an atmosphere having an oxidizing power equal or higher than that of an atmosphere consisting of 1% by volume of oxygen and equal or smaller than that of an atmosphere consisting of 50% by volume of oxygen, the atmosphere having a dew point between −30 and +30° C.;

E. transferring the blank into a press tool;

F. hot-forming the blank at a temperature from 600 to 830° C. to obtain a part;

G. cooling of the part obtained in step F) to obtain a microstructure in steel being martensitic or martensito-bainitic or made of at least 75% in terms of volume fraction of equiaxed ferrite, from 5 to 20% in volume of martensite and bainite in amount less than or equal to 10% in volume.

2. The press hardening method as recited in claim 1 wherein in step B), the hydrogen barrier pre-coating does not comprise at least one of the elements chosen from Al, Fe, Si, Zn, and N.

3. The press hardening method as recited in claim 1 wherein in step B), the hydrogen barrier pre-coating consists of chromium.

4. The press hardening method as recited in claim 1 wherein no further pre-coating is deposited on top of the hydrogen barrier pre-coating between steps C) and G).

5. The press hardening method as recited in claim 1 wherein in step A), the aluminum-based pre-coating is present and based on aluminum and comprises less than 15% Si and less than 5.0% Fe, optionally 0.1 to 8.0% Mg and optionally 0.1 to 30.0% Zn, a remainder being Al.

6. The press hardening method as recited in claim 1 wherein the hydrogen barrier pre-coating of step B) is deposited by physical vapor deposition, by electrogalvanization or roll-coating.

7. The press hardening method as recited in claim 1 wherein in step D), the atmosphere has an oxidizing power equal or higher than that of an atmosphere consisting of 10% by volume of oxygen and equal or smaller than that of an atmosphere consisting of 30% by volume of oxygen.

8. The press hardening method as recited in claim 7 wherein in step D) the atmosphere is air.

9. The press hardening method as recited in claim 1 wherein in step D), the heat treatment is performed at a temperature between 840 and 950° C. to obtain a fully austenitic microstructure in the steel.

10. The method of claim 1, wherein the microstructure is martensitic.

* * * * *